US007431422B2

(12) United States Patent
Asanuma et al.

(10) Patent No.: US 7,431,422 B2
(45) Date of Patent: Oct. 7, 2008

(54) HEAD CLEANER AND IMAGE FORMING APPARATUS

(75) Inventors: Shoji Asanuma, Kanagawa (JP); Manabu Nonaka, Kanagawa (JP); Hajime Nishida, Kanagawa (JP); Akihiro Fujita, Kanagawa (JP); Eiki Yoshimizu, Kanagawa (JP); Shinichiro Naruse, Kanagawa (JP); Yasuhiro Kawashima, Kanagawa (JP); Taku Kudoh, Kanagawa (JP); Kazumasa Ishikawa, Kanagawa (JP); Yohzoh Dohki, Aichi (JP); Shigeyuki Ito, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 358 days.

(21) Appl. No.: 11/009,093

(22) Filed: Dec. 13, 2004

(65) Prior Publication Data

US 2005/0146554 A1 Jul. 7, 2005

(30) Foreign Application Priority Data

Dec. 15, 2003 (JP) ..... 2003-416707

(51) Int. Cl.
*B41J 2/165* (2006.01)

(52) U.S. Cl. ..... 347/33; 347/29; 347/32

(58) Field of Classification Search ..... 347/22, 347/29, 30, 32, 33
See application file for complete search history.

(56) References Cited

U.S. PATENT DOCUMENTS

| | | | | | |
|---|---|---|---|---|---|
| 5,815,176 | A * | 9/1998 | Rotering | 347/33 |
| 6,151,044 | A * | 11/2000 | Gaasch | 347/33 |
| 6,189,999 | B1 | 2/2001 | Pham et al. | |
| 6,357,851 | B1 * | 3/2002 | Gaasch | 347/33 |
| 6,454,385 | B1 | 9/2002 | Anderson et al. | |

FOREIGN PATENT DOCUMENTS

| | | | |
|---|---|---|---|
| EP | 0 494 693 | A1 | 7/1992 |
| EP | 0 494 693 | B1 | 1/1998 |
| EP | 1 356 943 | A2 | 10/2003 |
| JP | 62113554 | * | 5/1987 |
| JP | 406115083 | A * | 4/1994 |
| JP | 9-314852 | | 12/1997 |
| JP | 2000-141672 | | 5/2000 |

* cited by examiner

*Primary Examiner*—shih-wen hsieh
(74) *Attorney, Agent, or Firm*—Oblon, Spivak, McClelland, Maier & Neustadt, P.C.

(57) ABSTRACT

A head cleaner is disclosed that includes a blade that has a top face and wipes the nozzle face of a liquid droplet ejecting head that ejects liquid droplets from nozzles, and a cleaning part that cleans the top face of the blade.

25 Claims, 12 Drawing Sheets

HEAD CLEANER AND IMAGE FORMING APPARATUS

BACKGROUND OF THE INVENTION

1. Field of the Invention

The present invention relates generally to head cleaners and image forming apparatuses, and more particularly to a head cleaner cleaning the nozzle face of a liquid droplet ejecting head that ejects liquid droplets and an image forming apparatus including the head cleaner.

2. Description of the Related Art

Some of the image forming apparatuses, such as printers, facsimile machines, copiers, and multifunction apparatuses having printer, facsimile, and copier functions, include a liquid droplet ejecting head that ejects ink that is a recording liquid from fine nozzles, and form (record) images using the head.

In such inkjet recording apparatuses, ink droplets are ejected from fine ejection openings. Accordingly, clogging of ejection openings may be caused by increased ink viscosity or ink adhesion due to dryness, or bubbles generated in the ink, thus causing an ejection deficiency. A recovery device for recovering and maintaining the normal state of the ink ejection function is provided in order to prevent such ejection deficiencies.

As a recovery method using such a recovery device, for instance, one or an appropriate combination of two or more of: a maintenance recovery method that repairs ejection openings by filling a recording head with ink using pressuring means in the case of an ejection deficiency due to bubbles generated in the ejection openings during recording; a maintenance recovery method that performs preliminary ejection (flushing) in preparation for an increase in ink viscosity or ink adhesion due to natural evaporation of ink in ejection openings; and a maintenance recovery method that wipes off ink droplets or dust adhering to an ejection opening face, is employed.

As a head cleaner having a blade for wiping the nozzle face of a head, a head cleaner with blade cleaning means for cleaning a blade is known. For instance, Japanese Laid-Open Patent Application No. 2000-141672 (Document 1) discloses a head cleaning technique that wipes off ink, adhering to the wedge-shaped end of a blade at the time of performing wiping, with a wiper cleaning member by providing the wiper cleaning member to an ink cartridge mounted on a carrier.

Further, according to the technique disclosed in Japanese Laid-Open Patent Application No. 9-314852 (Document 2), a wiper member and a wiper cleaning member for cleaning the wiper member are provided at an interval so that ink adhering to the wiper member is discharged through the space between the wiper member and the wiper cleaning member, and after the end of wiping, the wiper member is deflected in the direction opposite to the wiping direction so that the wiper cleaning member moves ink adhering to the side of the wiper member to the wiper cleaning member.

With respect to recent image forming apparatuses using ink, use of pigment ink using organic pigment or carbon black as colorant has been studied or put into practice in order to enable high quality printing on plain paper. Unlike dye, however, pigment has no water solubility. Therefore, normally, pigment is mixed into water together with dispersant so as to be employed as aqueous ink where the pigment is stably dispersed into water by dispersing.

In general, such pigment ink has higher viscosity than dye ink, thus causing the problem of high viscosity. That is, there is a problem in that in the case of wiping off high viscosity ink adhering to the nozzle face of a recording head, the ink cannot be wiped off sufficiently by merely wiping with a blade having a wedge-shaped end as disclosed in Document 1.

On the other hand, in the case of performing wiping using a blade shaped to have a top face as disclosed in Document 2, it was observed that high viscosity ink did not flow to the side of the blade as early as low viscosity ink, so that the ink remained adhered to the top face and the side face of the blade.

When the next wiping operation is performed with the ink thus adhered, this is likely to result in incomplete wiping, thus causing a problem in that nozzle "drop-out" or jetting curving occurs.

Further, in the conventional head cleaner, a blade is cleaned immediately after a nozzle face is wiped. Accordingly, ink may adhere to the blade before wiping of the nozzle face is started, thus resulting in a problem in that wiping cannot be performed in a clean state.

SUMMARY OF THE INVENTION

Accordingly, it is a general object of the present invention to provide a head cleaner in which the above-described disadvantages are eliminated.

A more specific object of the present invention is to provide a head cleaner of better cleaning performance with a blade, and an image forming apparatus including the same.

The above objects of the present invention are achieved by a head cleaner including a blade configured to wipe a nozzle face of a liquid droplet ejecting head that ejects droplets of liquid from nozzles, the blade having a top face; and a cleaning part configured to clean the top face of the blade.

The above objects of the present invention are also achieved by a head cleaner including a blade configured to wipe a nozzle face of a liquid droplet ejecting head that ejects droplets of liquid from nozzles; and a cleaning part configured to clean the blade when the blade is positioned so as to be able to wipe the nozzle face of the liquid droplet ejecting head.

The above objects of the present invention are also achieved by an image forming apparatus including: a liquid droplet ejecting head configured to eject droplets of liquid from nozzles; and a head cleaner that includes a blade configured to wipe a nozzle face of the liquid droplet ejecting head, the blade having a top face, and a cleaning part configured to clean the top face of the blade.

The above objects of the present invention are also achieved by an image forming apparatus including: a liquid droplet ejecting head configured to eject droplets of liquid from nozzles; and a head cleaner that includes a blade configured to wipe a nozzle face of the liquid droplet ejecting head, and a cleaning part configured to clean the blade when the blade is positioned so as to be able to wipe the nozzle face of the liquid droplet ejecting head.

According to the above-described head cleaners and the image forming apparatuses according to the present invention, the head cleaners include a blade having a top face that cleans a nozzle face, and a cleaning part that cleans the top face of the blade. Therefore, even in the case of using a highly viscous recording liquid, it is ensured that the nozzle face is wiped and that reattachment of the recording liquid to the nozzle face is prevented. As a result, cleaning performance is improved.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Figure 1:
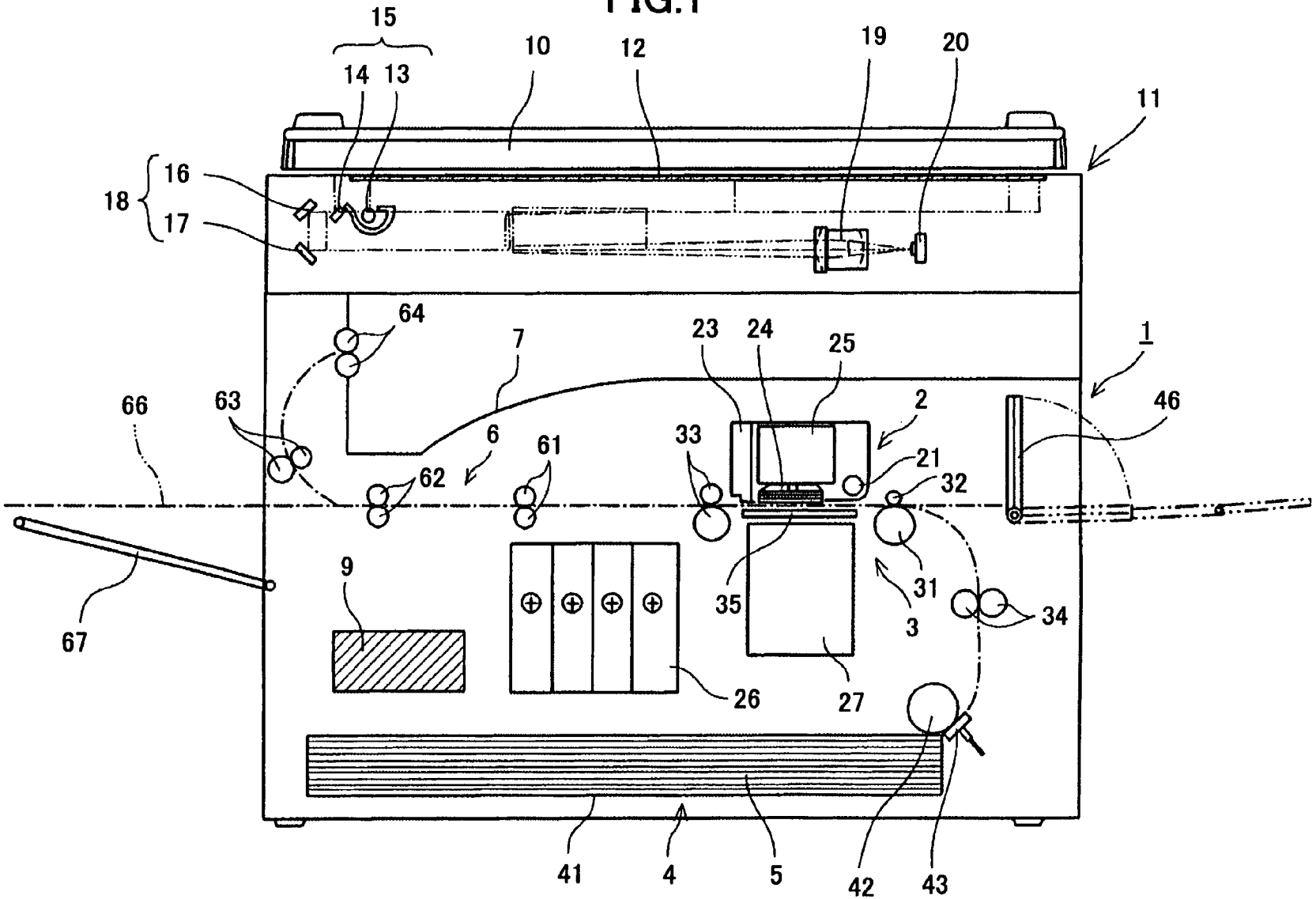
FIG. 1 is a schematic diagram showing an image forming apparatus according to the present invention.
Figure 2:
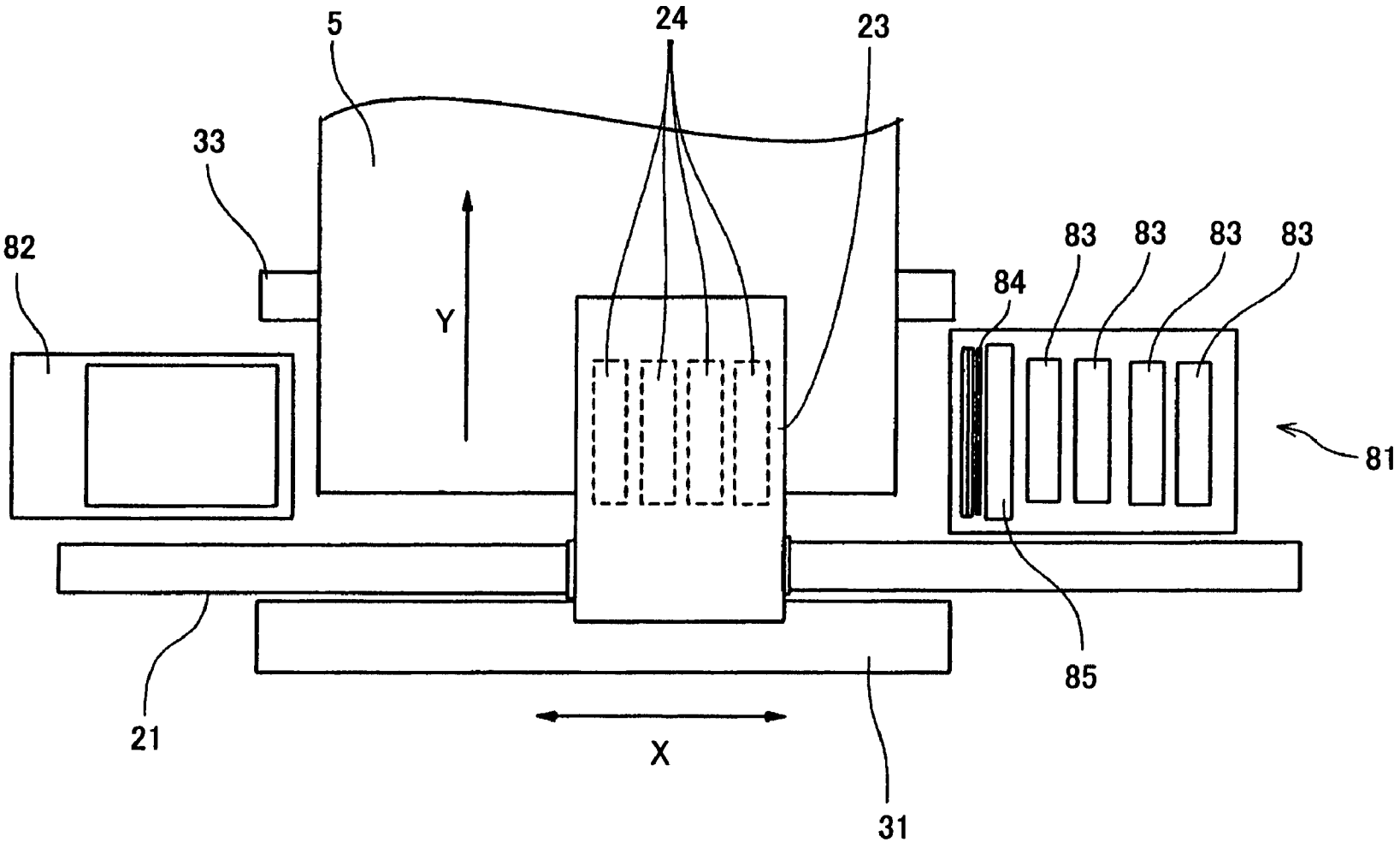
FIG. 2 is a plan view of an image formation part of the image forming apparatus according to the present invention.
Figure 3:
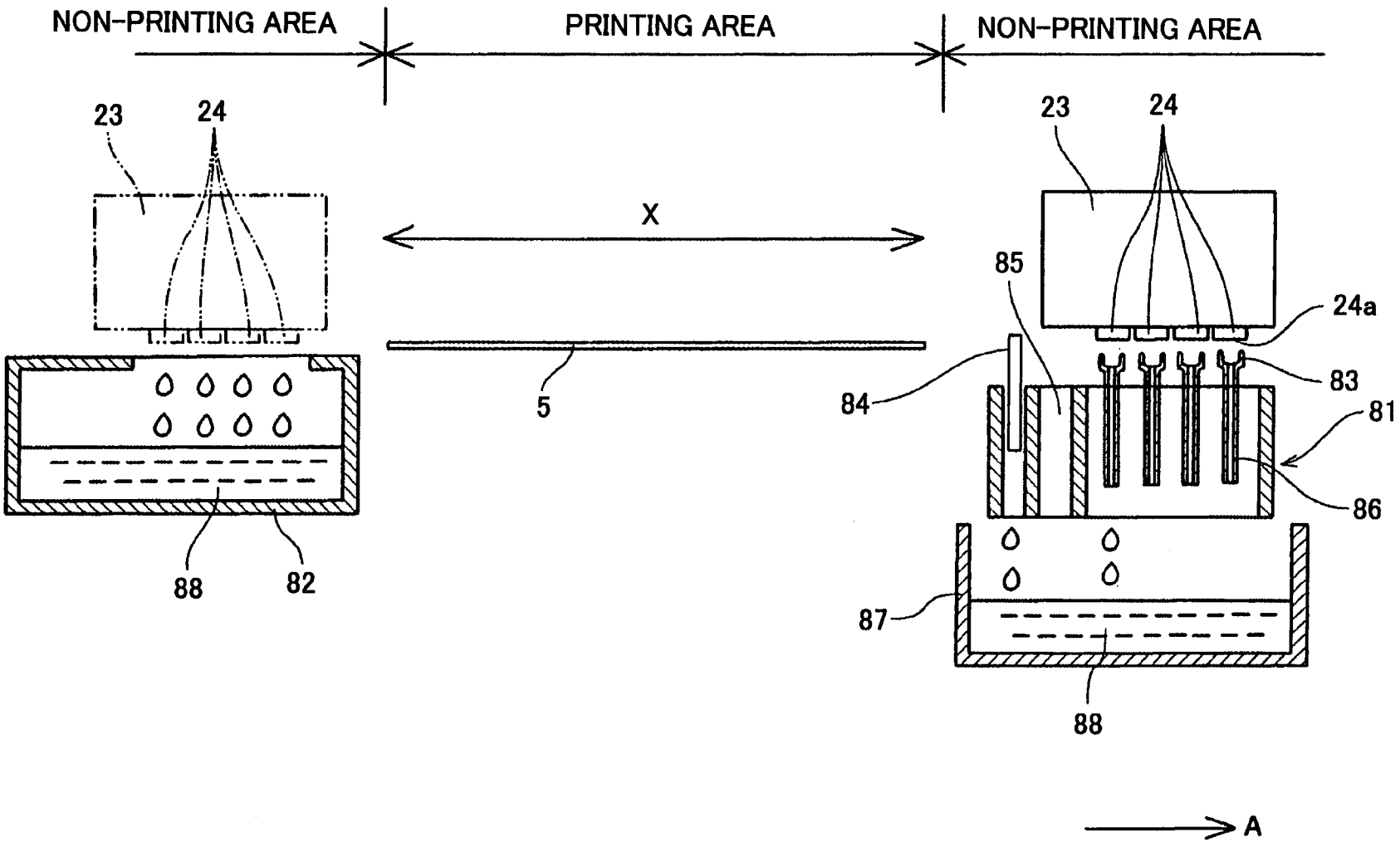
FIG. 3 is a front view of the image formation part shown in FIG. 2 according to the present invention.

A description is given below, with reference to the accompanying drawings, of embodiments of the present invention. First, a description is given, with reference to FIGS. 1 through 3, of an image forming apparatus according to the present invention that includes a head cleaner according to the present invention. FIG. 1 is a schematic diagram showing the image forming apparatus, FIG. 2 is a plan view of an image formation part 2 of the apparatus, and FIG. 3 is a front view of the image formation part 2 shown in FIG. 2.

The image forming apparatus includes an apparatus main body 1 (a housing), the image forming part 2, and a sub scanning conveyance part 3. The image forming part 2 and the sub scanning conveyance part 3 are provided in the apparatus main body 1. Recording media (hereinafter referred to as, but not limited to, paper sheets) 5 are fed one by one from a paper feed part 4 provided at the bottom of the apparatus main body 1. Each fed paper sheet 5 is conveyed to be positioned opposite the image formation part 2 by the sub scanning conveyance part 3. While the paper sheet 5 is being conveyed, the image formation part 2 ejects liquid droplets onto the paper sheet 5 to form (record) a necessary image thereon. Thereafter, the paper sheet 5 is output through an output paper conveyance part 6 onto an output paper tray 7 formed on the upper face of the apparatus main body 1. An electric component 9 including a control part controlling the apparatus is provided in the apparatus main body 1.

The image forming apparatus includes an image reading part (a scanner part) 11 for reading images as an input system for inputting image data (printing data) to be formed in the image formation part 2. The image reading part 11 is provided above the output paper tray 7 on the apparatus main body 1. The image reading part 11 reads the image of an original (for instance, a document) placed on a contact glass 12 by moving a scanning optical system 15 including a lighting light source 13 and a mirror 14 and a scanning optical system 18 including mirrors 16 and 17. The scanned original image is read as an image signal by an image reading device 20 disposed behind a lens 19. The read image signal is digitized and subjected to image processing, so that the image-processed printing data can be printed. A press plate 10 for holding the original is provided on the contact glass 12.

Further, this image forming apparatus has an input system that can receive printing data including image data from host-side apparatuses including information processors such as external personal computers, image readers such as external image scanners, and image capturing apparatuses such as external digital cameras through cables or a network as the image data (printing data) to be formed by the image formation part 2. The image forming apparatus can process and print the received printing data.

Referring also to FIG. 2, the image formation part 2 of the image forming apparatus of FIG. 1 is of a shuttle type. That is, according to the image formation part 2, multiple recording heads 24 that eject liquid droplets of respective colors different from each other are mounted on a carriage 23, which is movable back and forth in a main scanning direction (or movable in carriage scanning directions), guided by a carriage guide 21. The main scanning direction refers to a direction perpendicular to a direction in which the paper sheet 5 is conveyed (a paper sheet conveyance direction or a sub scanning direction). In FIG. 2, the carriage scanning directions are indicated by double-headed arrow X, and the paper sheet conveyance direction (sub scanning direction) is indicated by arrow Y. While the carriage 23 is moved along the main scanning direction and the paper sheet 5 is conveyed in the paper sheet conveyance direction (sub scanning direction), liquid droplets are ejected from the recording heads 24 so that an image is formed.

The recording heads 24 are composed of four liquid droplet ejecting heads respectively ejecting black (Bk) ink, cyan (C) ink, magenta (M) ink, and yellow (Y) ink. The color inks are supplied from respective sub-tanks 25 mounted on the carriage 23.

The sub-tanks 25 are replenished with their respective color inks supplied via tubes (not graphically illustrated) from corresponding ink cartridges 26 (FIG. 1), which are main tanks containing the respective color inks that are attached inside the apparatus main body 1 so as to be detachable (and reattachable). Besides the recording heads 24 ejecting ink droplets, a recording head ejecting processing liquid for fixation (fixing ink) that reacts with recording liquid (ink) to increase its fixation characteristic or a recording head ejecting liquid droplet of another color may be provided.

The types of liquid droplet ejecting heads composing the recording heads 24 may be, for instance, a so-called piezoelectric type, a so-called thermal type, and an electrostatic type. Piezoelectric-type heads employ a piezoelectric element as a pressure generation part (an actuator part) to increase pressure inside a liquid channel (a pressure generation chamber). The piezoelectric-type heads deform a diaphragm forming a wall face of the liquid channel using the piezoelectric element, thereby changing the internal volume of the liquid channel to eject liquid droplets. The thermal-type heads eject liquid droplets by pressure due to air bubbles generated by applying heat to recording liquid inside a liquid channel using a heat element. The electrostatic-type heads deform a diaphragm forming a wall face of a liquid channel by an electrostatic force generated between the diaphragm and an electrode disposed opposite the diaphragm, thereby changing the internal volume of the liquid channel to eject liquid droplets.

The sub scanning conveyance part 3 includes a printing part conveyance roller pair 34, a printing part conveyance roller 31, a pressing roller 32, a printing part conveyance roller pair 33, and a paper sheet guide plate 35. The printing part conveyance roller pair 34 conveys upward the paper sheet 5 fed from the paper feed part 4. The printing part conveyance roller 31, which is disposed on the upstream side of the image formation part 2 in the paper sheet conveyance direction, conveys the paper sheet 5, changing its direction of conveyance by substantially 90°. The pressing roller 32 also functions as a roller defining the angle of feeding of the paper sheet 5 from the printing part conveyance roller 31. The printing part conveyance roller pair 33 is disposed on the downstream side of the image formation part 2 in the paper sheet conveyance direction, and conveys the paper sheet 5. The paper sheet guide plate 35 is disposed opposite the image formation part 2 so as to guide the lower face of the paper sheet 5. According to this configuration, the paper sheet 5 is conveyed with conveyance rollers. Alternatively, for instance, the paper sheet 5 may also be conveyed with a conveyor belt that attracts (adheres) and conveys the paper sheet by an electrostatic force.

The paper feed part 4 includes a paper feed cassette 41, a paper feed roller 42, and a friction pad 43. The multiple paper sheets 5 are stacked and contained in the paper feed cassette 41, which can be inserted into and pulled out from the apparatus main body 1. The paper feed roller 42 and the friction pad 43 are provided so as to separate and feed the paper sheets 5 in the paper feed cassette 41 one by one.

The image forming apparatus includes a manual tray 46 in order to perform manual paper feeding and straight paper outputting. The manual tray 46, in which the paper sheets 5 can be stacked and contained, is provided to one side of the apparatus main body 1 so as to be able to be turned down and opened.

The output paper conveyance part 6 includes an output paper conveyance roller pair 61, paper outputting rollers 62, an output paper conveyance roller pair 63, and output rollers 64. The output paper conveyance roller pair 61 conveys the paper sheet 5 on which an image has been formed. The output paper conveyance roller pair 63 and the output rollers 64 are provided so as to output the paper sheet 5 sent out from the paper outputting rollers 62 onto the output paper tray 7. The output paper conveyance part 6 further includes a straight paper output path 66 for conveying straight and outputting the paper sheet 5 having the image formed on it. The paper sheet 5 may be output from the paper outputting rollers 62 through the straight paper output path 66 onto a straight paper output tray 67 provided to the other side of the apparatus main body 1 so as to be able to be turned down and opened. The switching of paper output paths is performed by a switching plate (not graphically illustrated).

In this image forming apparatus, as shown in FIGS. 2 and 3, a maintenance and recovery mechanism (hereinafter referred to as "sub-system") 81 for maintaining and recovering the condition of the nozzles of the recording heads 24 is disposed in a non-printing area on one side of a printing area in the scanning directions of the carriage 23. The sub-system 81 includes a head cleaner according to the present invention. In a non-printing area on the other side of the printing area, a blank ejection (flushing) receiver 82 receiving waste liquid 88 such as flushed recording liquid is provided.

The sub-system 81 includes a cap member 83 for each of the recording heads 24, a wiper blade 84, and a blank ejection (flushing) reception part 85. Each cap member 83 caps a nozzle face 24*a* of the corresponding recording head 24 so as to maintain moisture and perform suction. The wiper blade 84 wipes the nozzle face 24*a* of each recording head 24. The blank ejection reception part 85 is provided in order to flush the recording heads 24.

An ejection receiver 87 receiving the waste liquid 88 such as recording liquid suctioned from the cap members 83 to be ejected through waste liquid tubes 86, recording liquid removed from the wiper blade 84, and flushed recording liquid is disposed below the sub-system 81.

In the case of performing a maintenance and recovery operation by this sub-system 81, first, the nozzle faces 24*a* of the recording heads 24 are capped by the corresponding cap members 83, and suction from the nozzles of the recording heads 24 is performed by a suction part such as a pump (not graphically illustrated). Thereafter, the wiper blade 84 wipes and cleans the nozzle faces 24*a* of the recording heads 24, and the nozzle faces 24*a* of the recording heads 24 are recapped by the corresponding cap members 83. Alternatively, recording liquid is flushed from the recording heads 24 with increased liquid viscosity into the blank ejection reception part 85 before starting printing. Thereafter, the wiper blade 84 is moved upward to a position where wiping is performable (a wiping-performable position) and wipes and cleans the nozzle faces 24*a*. Then, printing is started.

The wiper blade 84 performs wiping as follows. The wiper blade 84 is moved upward to the wiping-performable position of FIG. 3 (in the vertical direction), and the carriage 23 is moved along the main scanning direction. As a result, the wiper blade 84 is moved in a wiping direction indicated by arrow A in FIG. 3 relative to the nozzle faces 24*a* of the recording heads 24, thereby wiping the nozzle faces 24*a* so that recording liquid adhering to the nozzle faces 24*a* is wiped off.

Figure 4A:
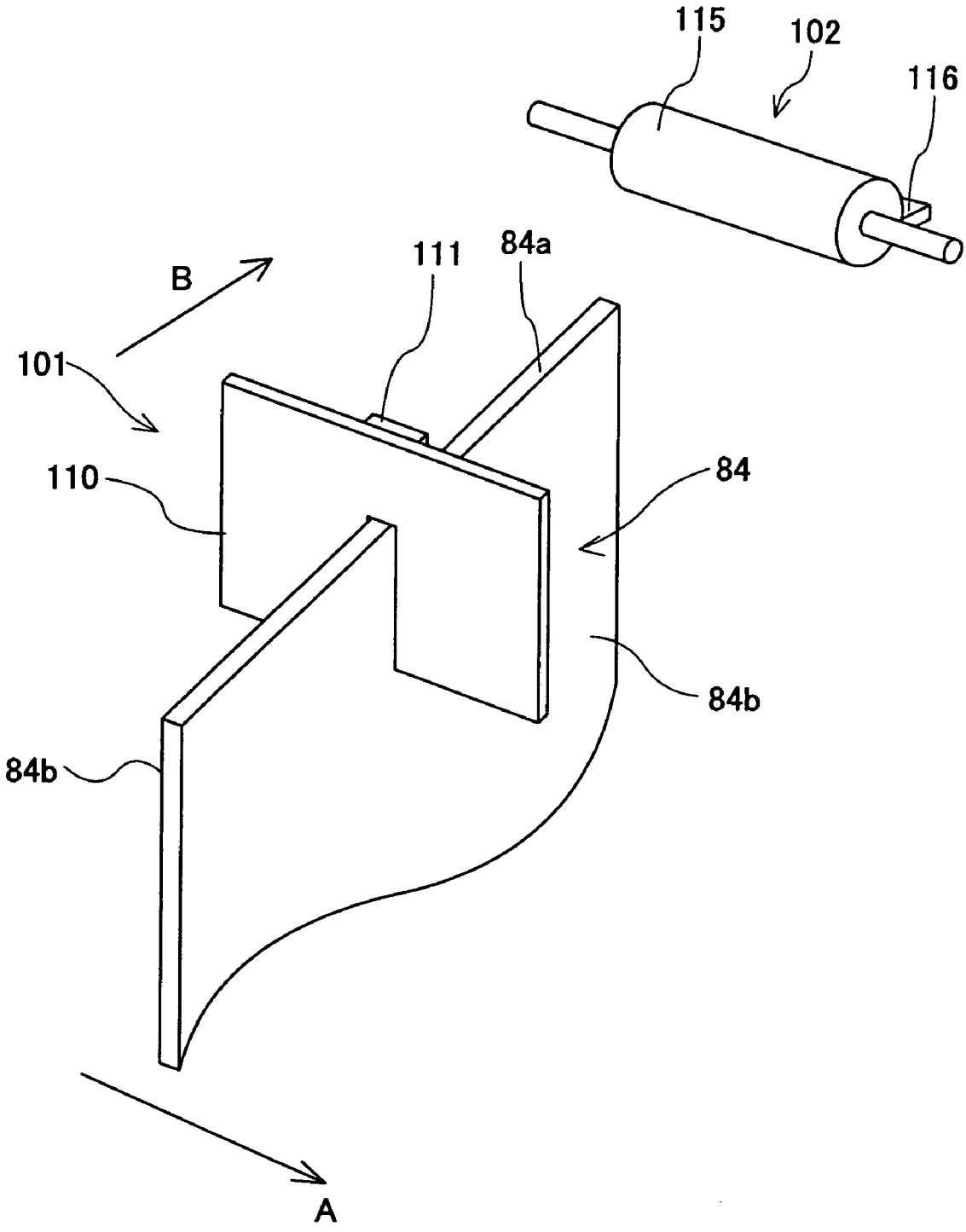
FIGS. 4A and 4B are schematic perspective views of a first embodiment of a head cleaner applied to the image forming apparatus according to the present invention.
Figure 4B:
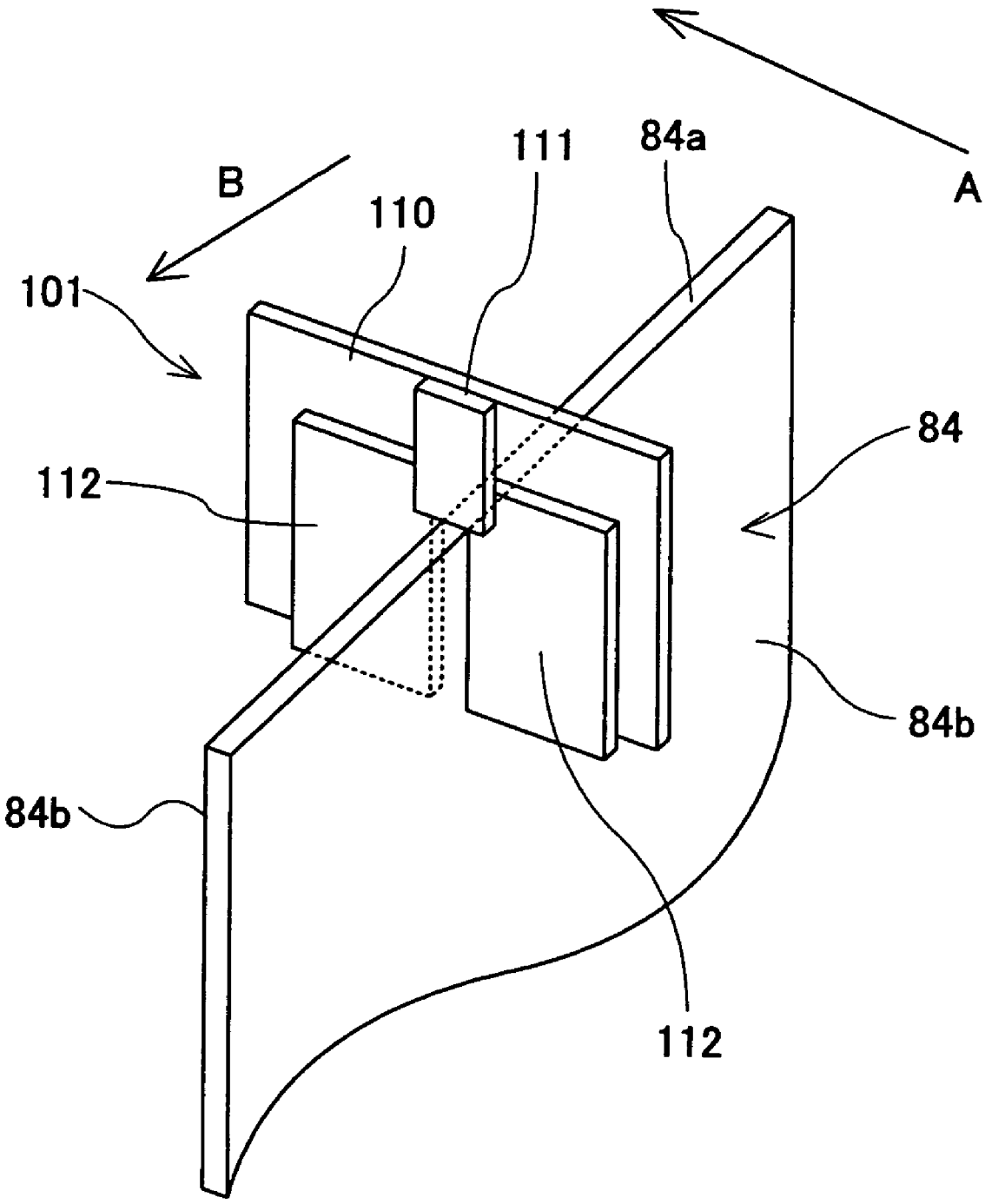

A description is given, with reference to FIGS. 4A and 4B, of a first embodiment of the head cleaner according to the present invention applied to the sub-system 81.

According to this embodiment, the head cleaner includes a cleaning part 101 and a scraping part 102. FIG. 4A shows one side of the cleaning part 101, and FIG. 4B shows the other side of the cleaning part 101 together with the scraping part 102. The cleaning part 101 is movable back and forth in a direction indicated by arrow B in FIGS. 4A and 4B, which is perpendicular to the wiping direction A (FIGS. 3, 4A and 4B), so as to remove recording liquid adhering to a top face 84*a* and side faces 84*b* of the wiper blade 84. The top face 84*a* may be configured to be substantially parallel to the nozzle faces 24*a*. The scraping part 102 transfers thereto the recording liquid removed from the wiper blade 84 by the cleaning part 101, and scrapes off the transferred recording liquid.

The cleaning part 101 has an upper face scraping Mylar member 111 and a side face scraping Mylar member 112 provided to a holding member 110. The upper face scraping Mylar member 111 scrapes off recording liquid adhering to the top face 84*a* of the wiper blade 84, and the side face scraping Mylar member 112 scrapes off recording liquid adhering to the side faces 84*b* of the wiper blade 84.

The scraping part 102 has a transfer roller 115 and a scraping Mylar member 116. The transfer roller 115 transfers thereto the recording liquid adhering to the Mylar members 111 and 112 of the cleaning part 101. The scraping Mylar member 116 scrapes off the recording liquid transferred to the transfer roller 115.

According to this embodiment, when the wiper blade 84 moves upward to the wiping-performable position, the cleaning part 101 is in an evacuation position, being evacuated from the area of movement of the wiper blade 84. After the wiper blade 84 has moved up to the wiping-performable position and wiped the nozzle face 24*a* of the corresponding recording head 24 by relative movement with respect to the carriage 23, the cleaning part 101 moves to a cleaning position shown in FIGS. 4A and 4B and moves in the B direction. As a result, the upper face scraping Mylar member 111 and the side face scraping Mylar member 112 scrape off recording liquid adhering to the top face 84*a* and the side faces 84*b*, respectively, of the wiper blade 84, thereby cleaning the top face 84*a* and the side faces 84*b*.

Thereafter, the cleaning part 101 is moved toward the scraping part 102 so that the recording liquid adhering to the upper face scraping Mylar member 111 and the side face scraping Mylar member 112 is transferred to the transfer roller 115 and is scraped off into the ejection receiver 87 by the scraping Mylar member 116.

Thus, even in the case of employing recording liquid of high viscosity (viscosities of 5 mPa•s through 20 mPa•s at 25° C.), it can be ensured that the recording liquid adhering to the nozzle face 24*a* of each recording head 24 is wiped off by wiping the nozzle face 24*a* of each recording head 24 using the wiper blade 84 having the top face 84*a* as a blade.

Since the cleaning part 101 that scrapes and cleans the top face 84*a* of the wiper blade 84 is provided, it can be ensured that recording liquid adhering to the top face 84*a* of the blade 84 is removed even if the recording liquid is highly viscous. As a result, it is possible to prevent the recording liquid adhering to the top face 84*a* of the wiper blade 84 from being transferred to a nozzle face in the next wiping operation. Accordingly, the recording liquid adhering to the nozzle faces 24*a* of the recording heads 24 can be wiped off with certainty.

In this case, the wiper blade 84 may move up to the wiping-performable position in order to wipe the nozzle face 24*a* of one of the recording heads 24 and move down therefrom after the wiping, and thereafter, the cleaning part 101 cleans the wiper blade 84. This configuration may also apply to the following embodiments.

As a result, the wiper blade 84 can be clean in wiping the next recording head 24, thus preventing recording liquid from being retransferred to the nozzle face 24*a* of the next recording head 24. Accordingly, it is possible to perform wiping of high cleaning performance.

Figure 5:
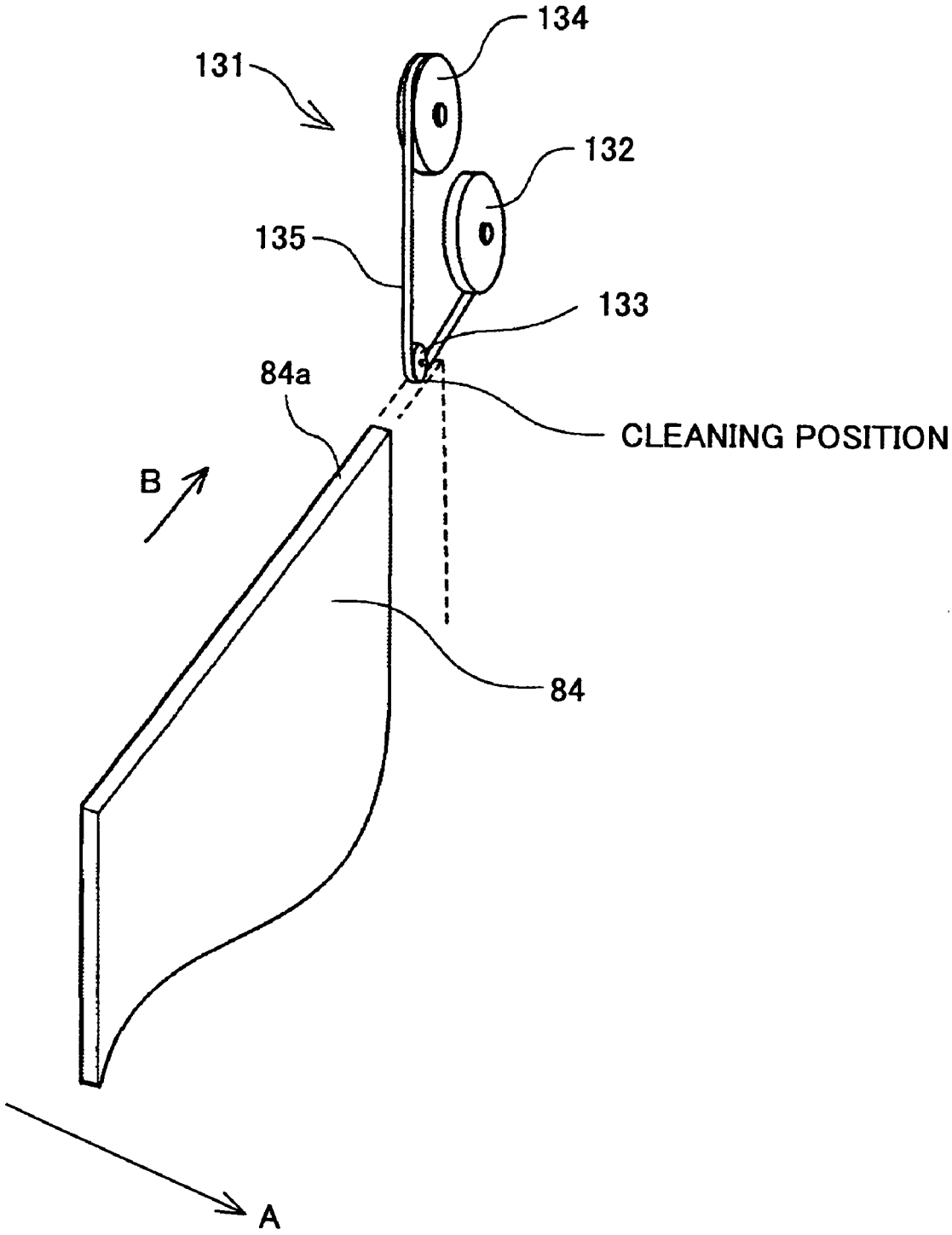
FIG. 5 is a schematic perspective view of a second embodiment of the head cleaner applied to the image forming apparatus according to the present invention.

Next, a description is given, with reference to FIG. 5, of a second embodiment of the head cleaner according to the present invention.

According to the second embodiment, the head cleaner includes wiping cloth 135 as a cleaning part 131 that cleans the top face 84*a* of the wiper blade 84. The wiping cloth 135 is a belt-like cloth member that is sent out from a sending roller 132 to be collected by a collection roller 134 via a pressing roller 133. At the time of cleaning the top face 84*a* of the wiper blade 84, the wiping cloth 135 is pressed against the top face 84*a* by the pressing roller 133 at a cleaning position so as to be able to wipe the top face 84*a* absorbing recording liquid adhering thereto.

According to this configuration, after cleaning the nozzle face 24*a* of one of the recording heads 24 with the wiper blade 84 before wiping the next recording head 24, for instance, the wiper blade 84 is moved in the B direction so that the wiping cloth 135 is pressed against the top face 84*a* of the wiper blade 84 by the pressing roller 133. Then, the wiper blade 84 is moved further in the B direction while the wiping cloth 135 is being wound around and collected by the collection roller 134 with a driving part (not graphically represented) rotating the collection roller 134. As a result, the recording liquid adhering to the top face 84*a* of the wiper blade 84 is wiped, being absorbed by the wiping cloth 135.

As a result, the wiper blade 84 can be clean in wiping the next recording head 24, thus preventing recording liquid from being retransferred to the nozzle face 24*a* of the next recording head 24. Accordingly, it is possible to perform wiping of high cleaning performance.

In the illustrated case, the wiper blade 84 is moved in the B direction to perform cleaning. Alternatively, the cleaning part 131 may be configured to move along the wiper blade 84.

Figure 6:
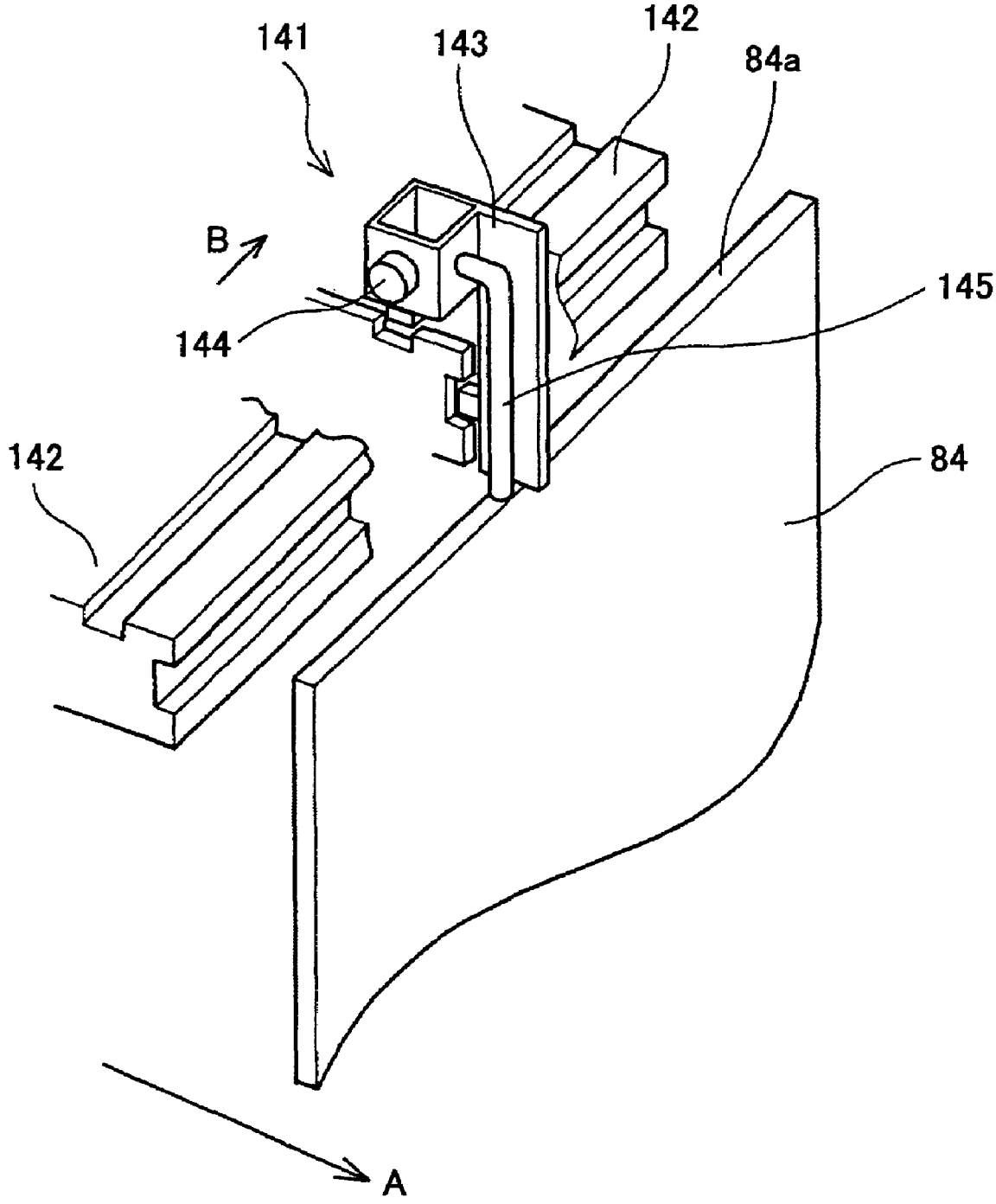
FIG. 6 is a schematic perspective view of a third embodiment of the head cleaner applied to the image forming apparatus according to the present invention.

Next, a description is given, with reference to FIG. 6, of a third embodiment of the head cleaner according to the present invention.

According to the third embodiment, the head cleaner includes a suction pump 144 as a cleaning part 141 that cleans the top face 84*a* of the wiper blade 84. The suction pump 144 is held by a holding member 143 that is movable back and forth in the B direction along a guide rail 142. A suction tube 145 that moves following the top face 84*a* of the wiper blade 84 is connected to the end of the suction pump 144.

According to this configuration, after cleaning the nozzle face 24*a* of one of the recording heads 24 with the wiper blade 84 before wiping the next recording head 24, it is possible to move the cleaning part 141 in the B direction and clean the top face 84*a* of the wiper blade 84 by taking suction on and removing recording liquid adhering thereto with the suction pump 144 through the suction tube 145.

As a result, the wiper blade 84 can be clean in wiping the next recording head 24, thus preventing recording liquid from being retransferred to the nozzle face 24*a* of the next recording head 24. Accordingly, it is possible to perform wiping of high cleaning performance.

Figure 7:
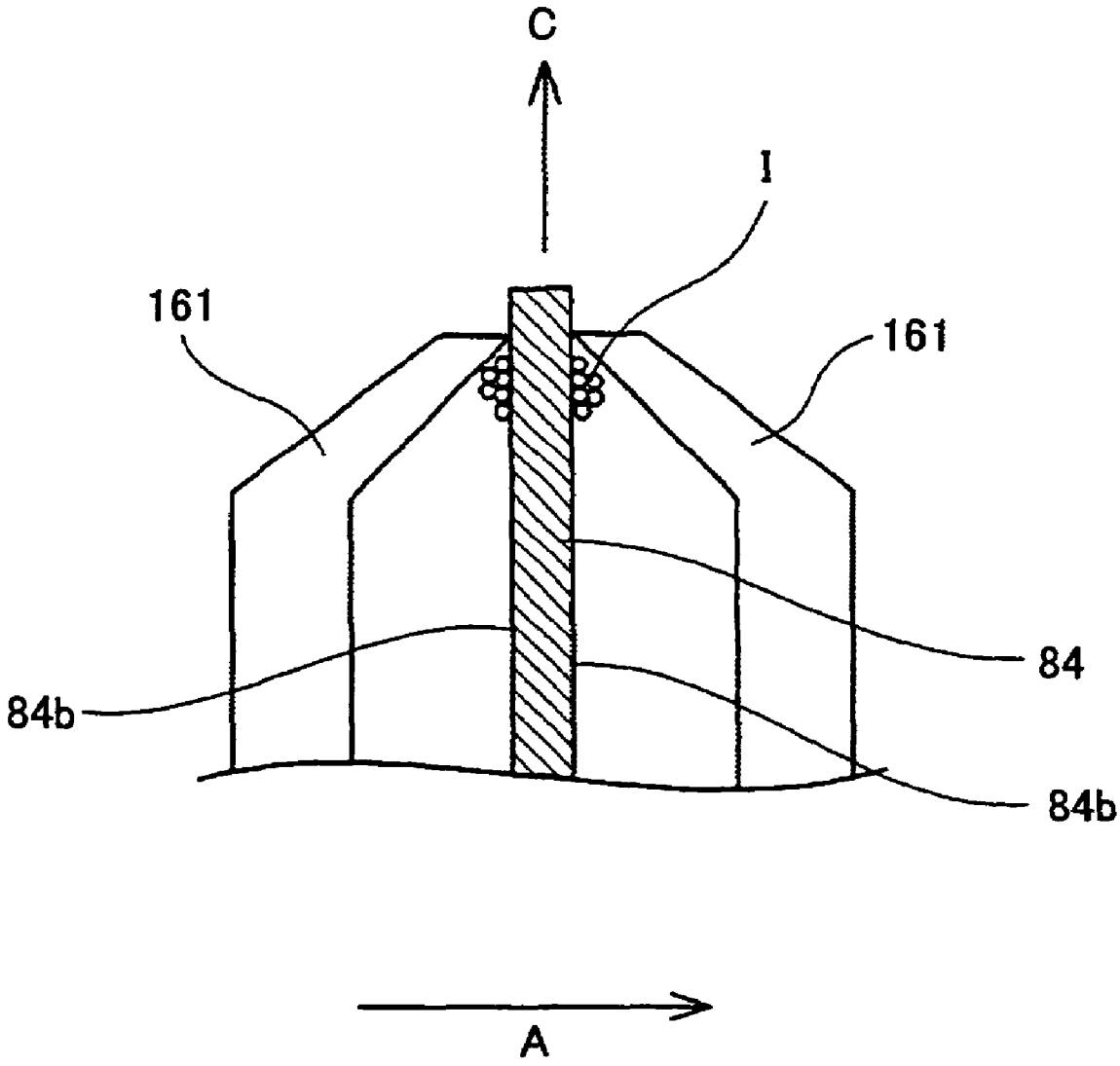
FIG. 7 is a schematic diagram for illustrating a fourth embodiment of the head cleaner applied to the image forming apparatus according to the present invention.

Next, a description is given, with reference to FIG. 7, of a fourth embodiment of the head cleaner according to the present invention.

According to the fourth embodiment, the head cleaner includes wiping blades 161 serving as a cleaning part that scrapes off recording liquid I adhering to the side faces 84*b* of the wiper blade 84 when the wiper blade 84 moves (upward) to the wiping-performable position. It is preferable that the wiping blades 161 be disposed so as to be able to move to a scraping position shown in FIG. 7 in conjunction with the upward movement of the wiper blade 84 and to move back from the scraping position when the wiper blade 84 moves downward. That is, the wiping blades 161 may move toward each other (toward the wiper blade 84) to the scraping position when the wiper blade 84 moves upward, and move away from each other (away from the wiper blade 84) when the wiper blade 84 moves downward.

As a result, when the wiper blade 84 moves upward in a direction indicated by arrow C in FIG. 7 to reach the wiping-performable position so as to wipe the nozzle faces 24*a* of the recording heads 24, it is possible to scrape off the recording liquid I adhering to the side faces 84*b* of the wiper blade 84 with the scraping blades 161. Accordingly, the wiper blade 84 can perform wiping with the side faces 84*b* being cleaned, so that it is possible to prevent the recording liquid I adhering to the side faces 84*b* of the wiper blade 84 from being retransferred to the nozzle faces 24*a* of the recording heads 24.

The scraping blades 161 that scrape and wipe the side faces 84*b* of the wiper blade 84 may be combined with the upper face scraping Mylar member 111 of the first embodiment, the cleaning part 131 of the second embodiment, or the cleaning part 141 of the third embodiment. As a result, it is possible to clean both the top face 84*a* and the side faces 84*b* of the wiper blade 84, thus further increasing cleaning performance.

Figure 8:
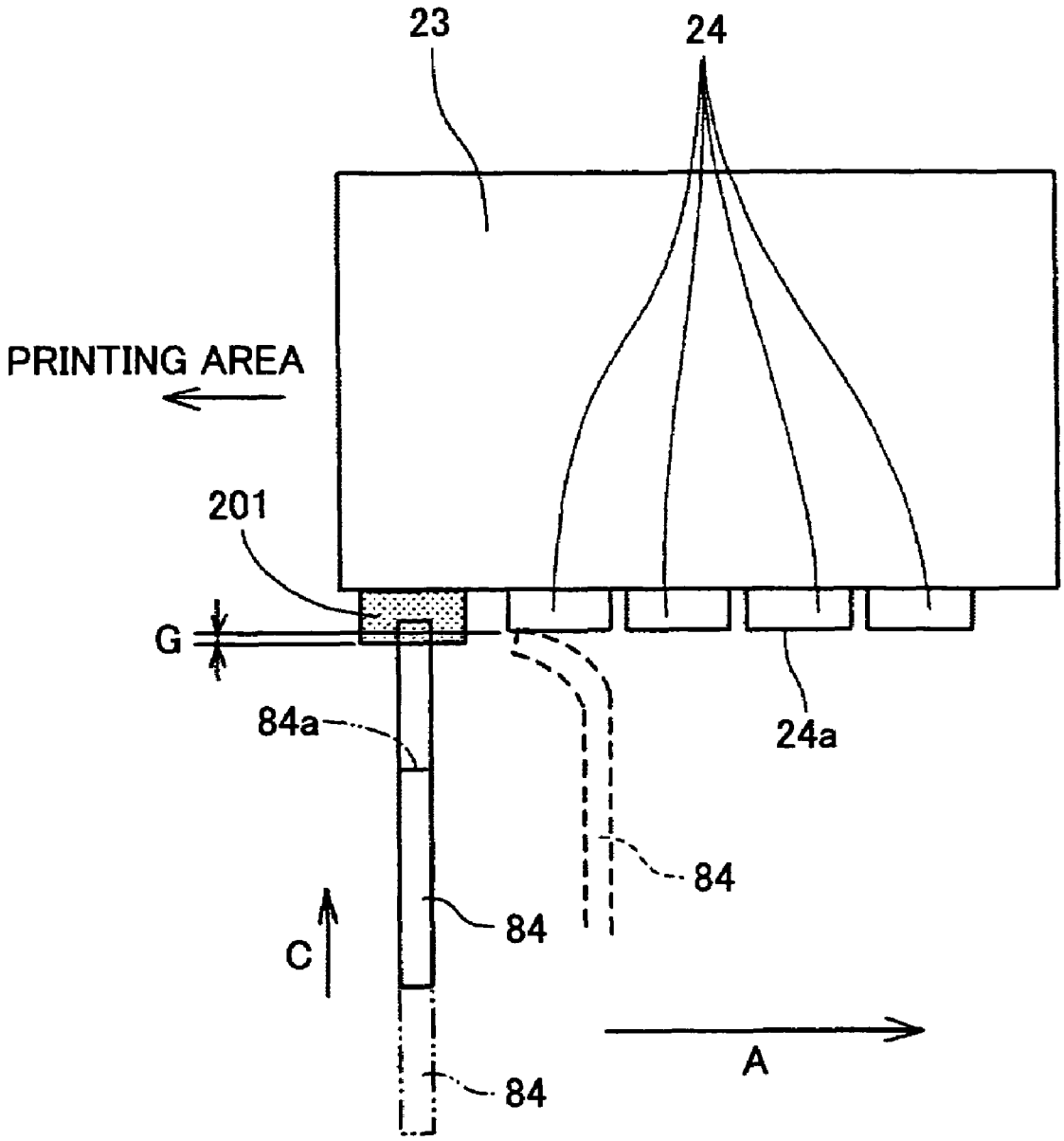
FIG. 8 is a schematic diagram for illustrating a fifth embodiment of the head cleaner applied to the image forming apparatus according to the present invention.

Next, a description is given, with reference to FIG. 8, of a fifth embodiment of the head cleaner according to the present invention.

According to the fifth embodiment, the head cleaner includes a cleaning member 201 as a cleaning part that cleans the top face 84*a* of the wiper blade 84. The cleaning member 201 is formed of an absorber for absorbing recording liquid adhering to the top face 84*a* of the wiper blade 84. The cleaning member 201 is provided to the face of the carriage 23 on the side of the recording heads 24, or the bottom face of the carriage 23.

The relationship between the positions of the bottom face of the cleaning member 201 (absorber) and the nozzle face 24*a* of each recording head 24 is defined so that the cleaning member 201 provided to the bottom face of the carriage 23 projects more in the downward direction than each recording head 24 by a vertical distance (height) G. Further, the cleaning member 201 is positioned furthest on the downstream side in the direction of movement of the carriage 23 toward the printing area. That is, the cleaning member 201 is disposed on the upstream side of the recording heads 24 in the wiping direction A.

According to this configuration, in the case of wiping the nozzle faces 24*a* of the recording heads 24 with the wiper blade 84, by moving the wiper blade 84 upward in the C direction so that the top face 84*a* of the wiper blade 84 comes into contact with the cleaning member 201 (absorber), the recording liquid remaining on the top face 84*a* of the wiper blade 84 is absorbed by the cleaning member 201, so that the top face 84*a* is cleaned.

As a result, the wiper blade 84 can be clean in wiping the recording heads 24, thus preventing the remaining recording liquid from being retransferred to the nozzle faces 24*a* of the recording heads 24. Accordingly, it is possible to perform wiping of high cleaning performance.

Any of this and the following embodiments, even if not so specified, may be combined with the fourth embodiment that cleans the side faces 84*b* of the wiper blade 84.

Figure 9:
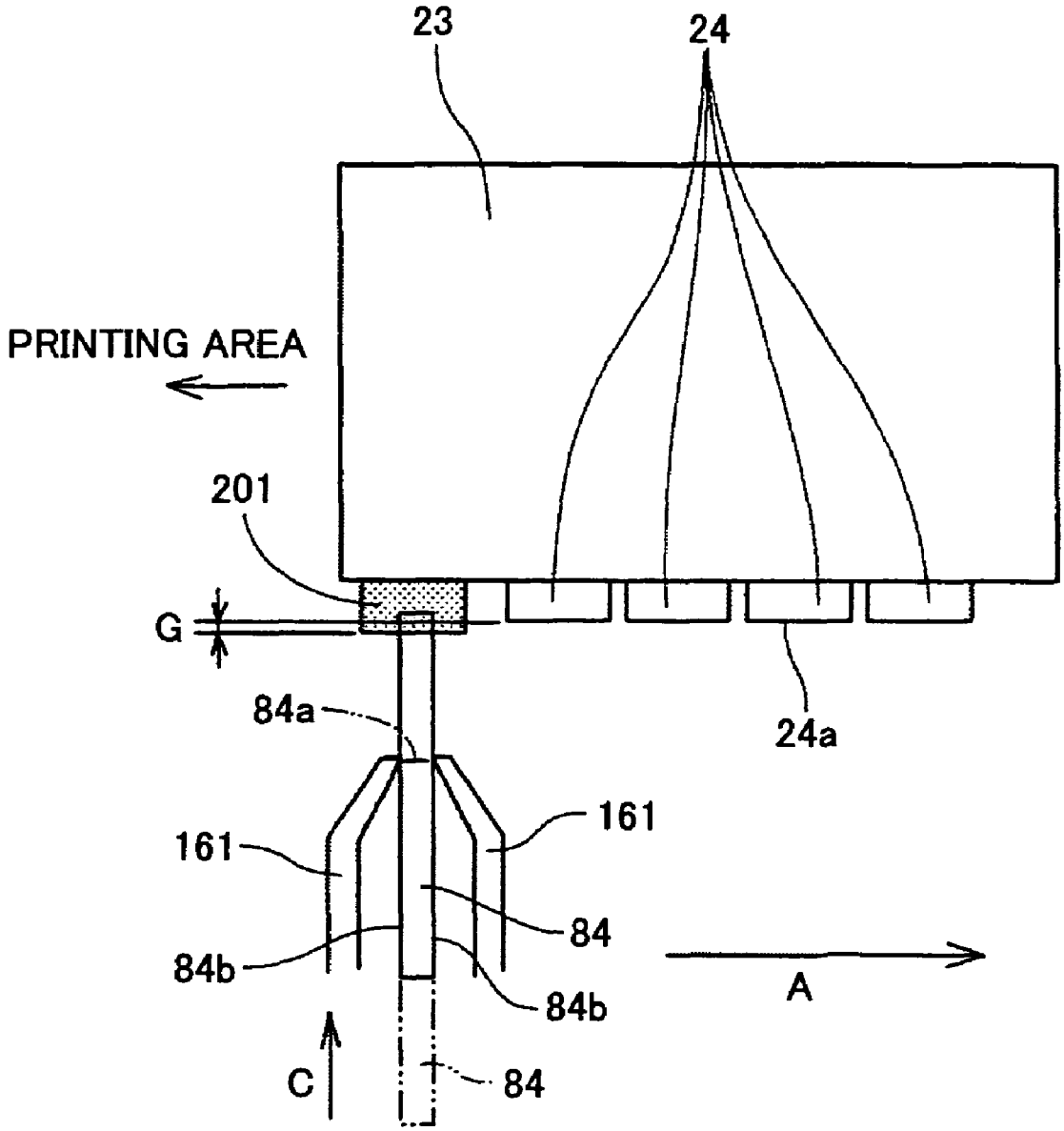
FIG. 9 is a schematic diagram for illustrating a sixth embodiment of the head cleaner applied to the image forming apparatus according to the present invention.

Next, a description is given, with reference to FIG. 9, of a sixth embodiment of the head cleaner according to the present invention.

According to the sixth embodiment, as in the above-described fifth embodiment, the head cleaner includes an absorber that can absorb recording liquid as the cleaning member 201 that removes recording liquid adhering to the top face 84*a* of the wiper blade 84, the absorber being provided to the bottom face of the carriage 23.

According to this embodiment, the relationship between the positions of the bottom face of the cleaning member 201 (absorber) and the nozzle face 24*a* of each recording head 24 is defined so that the cleaning member 201 provided to the bottom face of the carriage 23 projects more in the downward direction than each recording head 24 by the vertical distance (height) G. Further, the cleaning member 201 is positioned furthest on the downstream side in the direction of movement of the carriage 23 toward the printing area.

Further, as in the fourth embodiment, the head cleaner includes the wiping blades 161 serving as a cleaning part that scrapes off recording liquid adhering to the side faces 84*b* of the wiper blade 84 when the wiper blade 84 moves (upward) to the wiping-performable position. The wiping blades 161 may also be disposed so as to be able to move to a scraping position shown in FIG. 9 in conjunction with the upward movement of the wiper blade 84 and to move back from the scraping position when the wiper blade 84 moves downward.

According to this configuration, by causing the wiper blade 84 to move upward in the C direction in FIG. 9 to reach the wiping-performable position so as to wipe the nozzle faces 24*a* of the recording heads 24, the recording liquid adhering to the side faces 84*b* of the wiper blade 84 is scraped off by the scraping blades 161. Then, by bringing the top face 84*a* of the wiper blade 84 into contact with the cleaning member 201 (absorber), the recording liquid remaining on the top face 84*a* of the wiper blade 84 is absorbed by the cleaning member 201, so that the top face 84*a* is cleaned.

As a result, the top face 84 and the side faces 84*b* of the wiper blade 84 are cleaned so that the wiper blade 84 can be clean in wiping the recording heads 24. This prevents the remaining recording liquid from being retransferred to the nozzle faces 24*a* of the recording heads 24, thus making it possible to perform wiping of higher cleaning performance.

Figure 10:
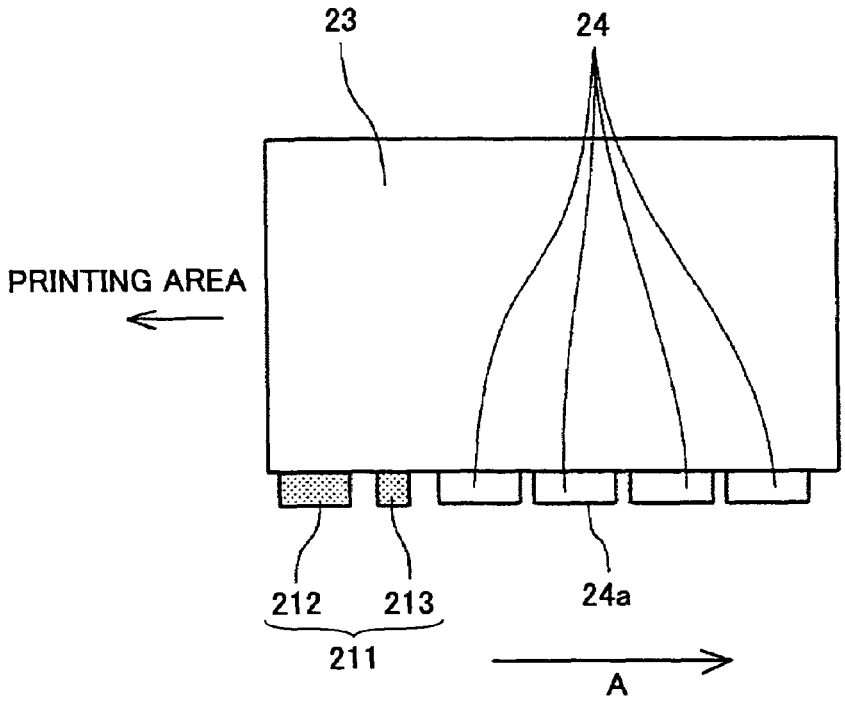
FIG. 10 is a schematic diagram for illustrating a seventh embodiment of the head cleaner applied to the image forming apparatus according to the present invention.

Next, a description is given, with reference to FIG. 10, of a seventh embodiment of the head cleaner according to the present invention.

According to the seventh embodiment, the head cleaner includes a first absorber 212 and a second absorber 213 as a cleaning part 211 that cleans the wiper blade 84. The first absorber 212 is a cleaning member that is relatively wide, or has a relatively great dimension, along the carriage scanning (moving) directions. The second absorber 213 is a cleaning member that is narrow along the carriage scanning (moving) directions relative to the first absorber 212.

The cleaning part 211 is positioned on the upstream side of the recording heads 24 in the wiping direction A. Of the cleaning part 211, the wider first absorber 212 is disposed on the upstream side of the second absorber 213 in the wiping direction A. That is, the narrower second absorber 213 is disposed on the downstream side of the first absorber 212 in the wiping direction A.

According to this configuration, cleaning of the nozzle faces 24*a* of the recording heads 24 can be started after removing recording liquid adhering to the top face 84*a* by moving the wiper blade 84 upward to bring the top face 84*a* into contact with the wider first absorber 212; and thereafter cleaning the side face 84*a* on the front side (downstream side) in the wiping direction A with the second absorber 213 by moving the wiper blade 84 relative to the carriage 23.

As a result, the top face 84 and the side faces 84*b* of the wiper blade 84 are cleaned so that the wiper blade 84 can be clean in wiping the recording heads 24. This prevents the remaining recording liquid from being retransferred to the nozzle faces 24*a* of the recording heads 24, thus making it possible to perform wiping of higher cleaning performance.

Figure 11:
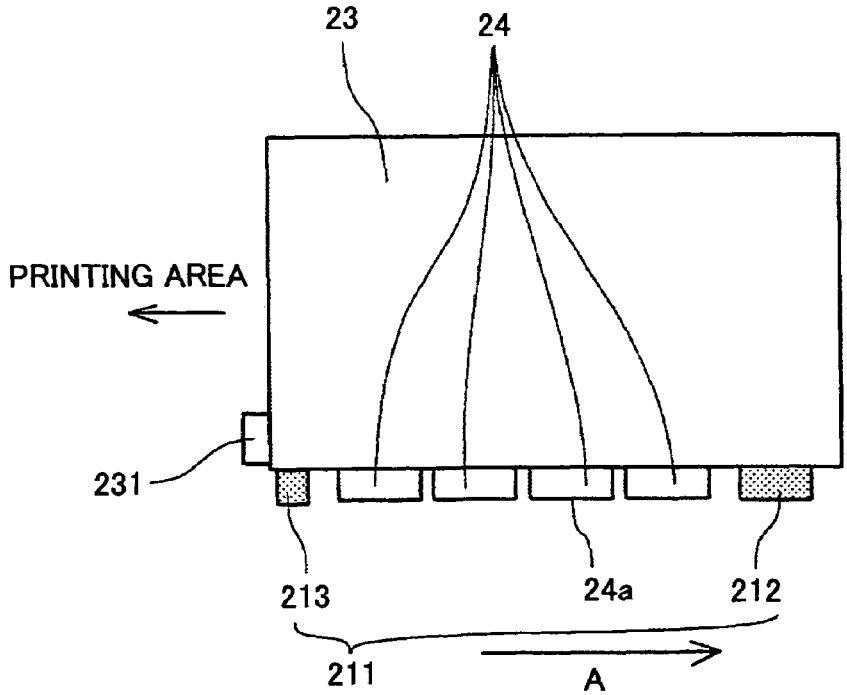
FIG. 11 is a schematic diagram for illustrating an eighth embodiment of the head cleaner applied to the image forming apparatus according to the present invention.

Next, a description is given, with reference to FIG. 11, of an eighth embodiment of the head cleaner according to the present invention.

According to the eighth embodiment, the head cleaner includes a sensor 231 that detects the leading edge, the trailing edge, the width in the main scanning direction, and other conditions of the paper sheet 5. The sensor 231 is provided on the face of the carriage 23 on the printing-area side.

Further, the head cleaner includes the first absorber 212, relatively wide in the wiping direction A, and the second absorber 213, narrower than the first absorber 212 in the wiping direction A, as the cleaning part 211 that cleans the wiper blade 84. The first and second absorbers 212 and 213 are provided on the bottom face of the carriage 23 on both sides of the arrangement of the recording heads 24, or at both ends along the wiping direction A.

As shown in FIG. 11, the first absorber 212 is disposed at the downstream end in the wiping direction A on the bottom face of the carriage 23, and the second absorber 213 is disposed at the upstream end in the wiping direction A on the bottom face of the carriage 23. The upstream end is on the side closer to the sensor 231.

According to this configuration, recording liquid adhering to the top face 84*a* is removed by moving the wiper blade 84 upward so as to bring the top face 84*a* into contact with the narrower second absorber 213, and thereafter, cleaning of the nozzle faces 24*a* of the recording heads 24 is started by moving the wiper blade 84 relative to the carriage 23. After cleaning the nozzle faces 24*a* of the recording heads 24, the side face 84*b* of the upper end portion of the wiper blade 84 on the front side in the wiping direction is cleaned with the first absorber 212.

As a result, the top face 84 and the side faces 84*b* of the wiper blade 84 are cleaned so that the wiper blade 84 can be clean in wiping the recording heads 24. This prevents the remaining recording liquid from being retransferred to the nozzle faces 24*a* of the recording heads 24, thus making it possible to perform wiping of higher cleaning performance.

Figure 12:
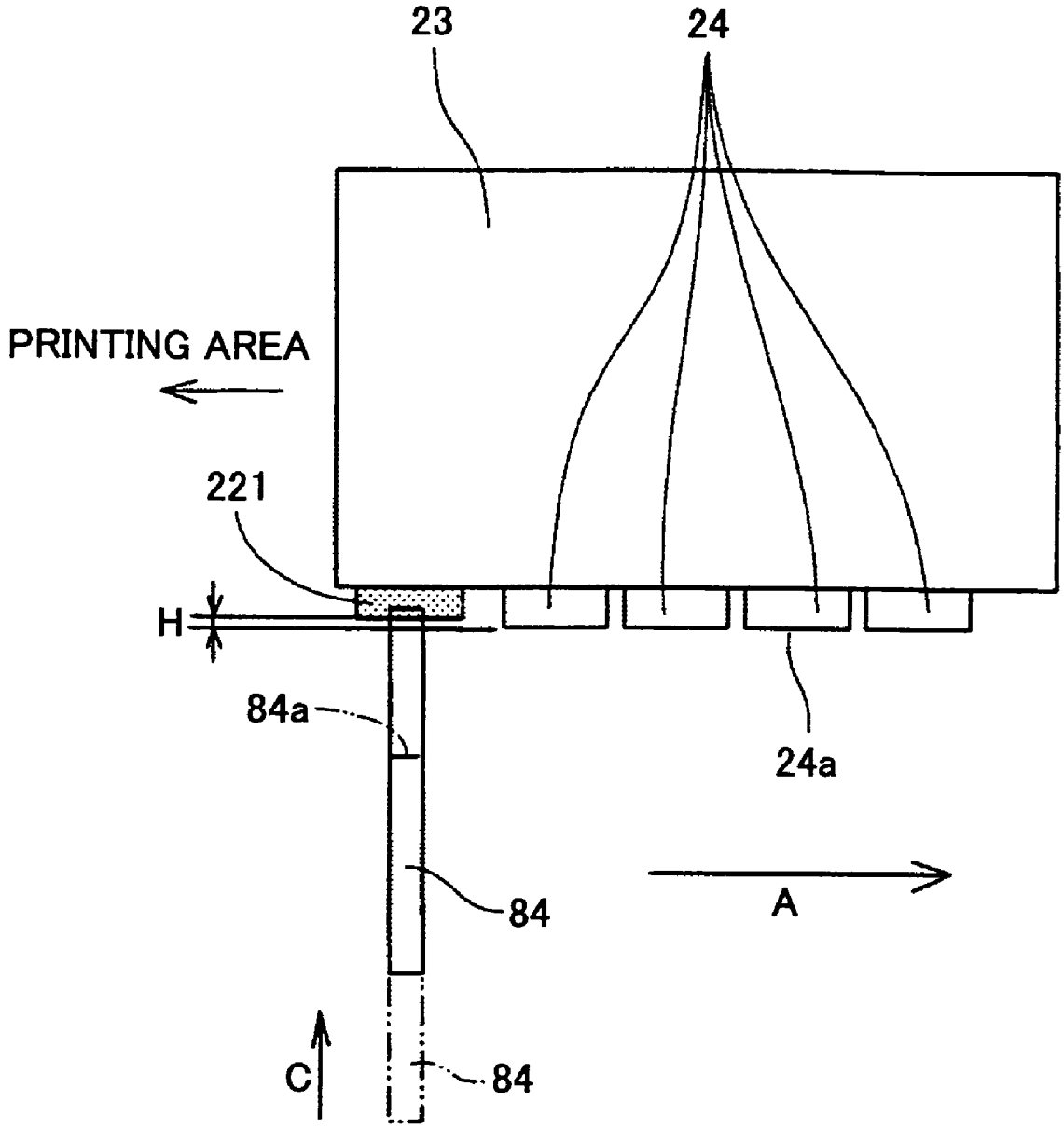
FIG. 12 is a schematic diagram for illustrating a ninth embodiment of the head cleaner applied to the image forming apparatus according to the present invention.

Next, a description is given, with reference to FIG. 12, of a ninth embodiment of the head cleaner according to the present invention.

According to the ninth embodiment, the head cleaner includes a cleaning member 221 as a cleaning part that removes recording liquid adhering to the top face 84*a* of the wiper blade 84. The cleaning member 221 is formed of an absorber that can absorb recording liquid. The cleaning member 221 is provided to the bottom face of the carriage 23.

The relationship between the positions of the bottom face of the cleaning member 221 (absorber) and the nozzle face 24*a* of each recording head 24 is defined so that the cleaning member 221 provided on the bottom face of the carriage 23 projects less in the downward direction than each recording head 24 by a vertical distance (height) H. Further, the cleaning member 221 is disposed on the upstream side of the recording heads 24 in the wiping direction A.

According to this configuration, in the case of wiping the nozzle faces 24*a* of the recording heads 24 with the wiper blade 84, the wiper blade 84 is moved upward in the C direction so that the top face 84*a* of the wiper blade 84 comes into contact with the cleaning member 221 (absorber). At this point, since the cleaning member 221 projects less in the downward direction than the nozzle faces 24*a* by the vertical distance H, the wiper blade 84 is moved up to a position higher than the wiping-performable position.

Then, after the recording liquid remaining on the top face 84*a* of the wiper blade 84 is absorbed by the cleaning member 221 (absorber) so that the top face 84*a* is cleaned, the wiper blade 84 is moved down to the wiping-performable position at which to clean the nozzle faces 24*a*. Then, the wiper blade 84 is moved relative to the carriage 23 so as to start to clean the nozzle faces 24*a* of the recording heads 24.

As a result, the wiper blade 84 can be clean in wiping the recording heads 24, thus preventing the remaining recording liquid from being retransferred to the nozzle faces 24*a* of the recording heads 24. Accordingly, it is possible to perform wiping of high cleaning performance.

According to the present invention, the head cleaner includes a blade having a top face that cleans a nozzle face, and a cleaning part that cleans the top face of the blade. Therefore, even in the case of using highly viscous recording liquid, it is ensured that the nozzle face is wiped and that reattachment of the recording liquid to the nozzle face is prevented. As a result, cleaning performance is improved.

Next, a description is given of ink, which is recording liquid employed in the above-described image forming apparatus. Examples of ink may include, but are not limited to, the following.

First, it is preferable that the static surface tension $\gamma$ of ink at 25° C. satisfy $\gamma \geqq 20$. This makes it possible to ensure ejection stability. That is, when the static surface tension $\gamma$ of ink at 25° C. satisfies $\gamma \geqq 20$, a liquid droplet is normally formed. Therefore, a clear image can be formed. On the other hand, in the case of $\gamma < 20$, a nozzle face is completely wetted with ink or ink shows a low contact angle. Accordingly, ink overflows into the vicinity of nozzles. In this state, no normal meniscuses are formed in the nozzles, so that no liquid droplets are formed normally. As a result, disadvantages such as a curved ejection direction, generation of unnecessary small droplets (satellite droplets), generation of mist, and in the worst case, no ejection of liquid droplets are caused. In such a state, it is impossible to form desired pixels. Therefore, image deficiency may be caused.

Ink contains a color material. The color material may be dissolved or dispersed to be contained. In this case, dyes are preferable as color materials that are employed dissolved. Color materials that are employed dispersed are pigments or dyes of low solubility in a solvent. High light resistance and water resistance may be obtained by employing pigments.

It is preferable for the ink to contain a dispersed color material. That is, when ink contains a dispersed color material, a pH change occurs the instant ink droplets land on a recording medium (paper sheet). As a result, the dispersion of the color material is broken up so that the color material condenses, or the color material catches on the meshes of the fibers of the recording medium so as to be prevented from flowing out far. As a result of the occurrence of such a phenomenon, feathering or color bleeding can be controlled, so that a clear image can be obtained.

On the other hand, in the case where ink contains a dissolved color material, even when a pH change occurs the moment ink droplets land on the recording medium, the dissolved color material does not precipitate easily, so that the color material does not condense. Further, when the ink penetrates into the recording medium, the dissolved color material is prevented from catching on the meshes of the fibers of the recording medium, so that the color material flows out far. These phenomena result in feathering or color bleeding, so that an unclear image may be formed.

Employable dyes include those classified as acid dye, direct dye, reactive dye, and food color in Color Index and having good water resistance and light resistance. These dyes may be used as a mixture of multiple types, or may be used in mixture with another coloring matter such as a pigment, which is added within a range that does not hinder the effects.

Specific examples of these dyes include C.I. acid yellow 17, 23, 42, 44, 79 and 142; C.I. acid red 1, 8, 13, 14, 18, 26, 27, 35, 37, 42, 52, 82, 87, 89, 92, 97, 106, 111, 114, 115, 134, 186, 249, 254 and 289; C.I. acid blue 9, 29, 45, 92 and 249; and C.I. acid black 1 and 2 as acid dyes and food colors.

As direct dyes, C.I. direct yellow 1, 12, 24, 26, 33, 44, 50, 86, 120, 132, 142 and 144; C.I. direct red 1, 4, 9, 13, 17, 20, 28, 31, 39, 80, 81, 83, 89, 225 and 227; C.I. direct orange 26, 29, 62 and 102; C.I. direct blue 1, 2, 6, 15, 22, 25, 71, 76, 79, 86, 87, 90, 98, 163, 165, 199 and 202; and C.I. direct black 19, 22, 32, 38, 51, 56, 71, 74, 75, 77, 154, 168 and 171 are included.

As reactive dyes, C.I. reactive black 3, 4, 7, 11, 12 and 17; C.I. reactive yellow 1, 5, 11, 13, 14, 20, 21, 22, 25, 40, 47, 51, 55, 65 and 67; C.I. reactive red 1, 14, 17, 25, 26, 32, 37, 44, 46, 55, 60, 66, 74, 79, 96 and 97; C.I. reactive blue 1, 2, 7, 14, 15, 23, 32, 35, 38, 41, 63, 80 and 95 are included.

In particular, acid dyes and direct dyes may be suitably used.

Specific examples of employable pigments are as follows. In this case, these pigments may be used as a mixture of multiple types, or may be used in mixture with another coloring matter such as a dye.

As organic pigments, azo-based pigments, phthalocyanine-based pigments, anthraquinone-based pigments, quinacridone-based pigments, dioxazine-based pigments, indigo-based pigments, thioindigo-based pigments, perylene-based pigments, isoindolinone-based pigments, aniline black, azomethine-based pigments, rhodamine B lake pigment, and carbon black are employable.

As inorganic pigments, ferric oxide, titanium oxide, calcium carbonate, barium sulfate, aluminum hydroxide, barium yellow, Prussian blue, cadmium red, chrome yellow, and metal powder are employable.

It is preferable that the above-described pigments be used in particles of 0.01-0.15 μm in particle size. If the particle size is less than or equal to 0.01 μm, hiding power is reduced, thus resulting in low density. Further, light resistance is reduced, so that the light resistance of ink in the case of mixing any of these pigments with a polymer dye is equal to that of a conventional dye. On the other hand, if the particle size is greater than or equal to 0.15 μm, head clogging or filter clogging may occur to prevent ejection stability from being obtained.

It is preferable to use a water-soluble organic solvent for ink in order to provide a desired physical property to the ink, to keep the ink from drying so as to prevent ejection deficiency, and to improve the solution stability and the dispersion stability of the color material. Examples of preferable water-soluble organic solvents include: polyhydric alcohols such as ethylene glycol, diethylene glycol, triethylene glycol, polyethylene glycol, polypropylene glycol, 1,5-pentanediol, 1,5-hexanediol, glycerol, 1,2,6-hexanetriol, 1,2,4-butanetriol, 1,2,3-butanetriol, and petriol; polyalcoholic alkyl ethers such as ethyleneglycol monoethyl ether, ethyleneglycol monobutyl ether, diethyleneglycol monomethyl ether, diethyleneglycol monoethyl ether, diethyleneglycol monobutyl ether, tetraethylene glycol monomethyl ether, and propyleneglycol monoethyl ether; polyalcoholic aryl ethers such as ethyleneglycol monophenyl ether and ethyleneglycol monobenzyl ether; nitrogen-containing heterocyclic compounds such as N-methyl-2-pyrrolidone, N-hydroxyethyl-2-pyrrolidone, 2-pyrrolidone, 1,3-dimethylimidazolidinone, and ε-caprolactam; amides such as formamide, N-methyl formamide, and N,N-dimethyl formamide; amines such as monoethanol amine, diethanol amine, triethanol amine, monoethyl amine, diethyl amine, and triethyl amine; sulfur-containing compounds such as dimethyl sulfoxide, sulforane, and thiodiethanol; propylenecarbonate; ethylene carbonate; and γ-butyrolactone. Each of these solvents may be used alone with water, or two or more of these solvents may be mixed to be used with water.

Of the above-described solvents, those particularly preferable are diethylene glycol, thiodiethanol, polyethylene glycol 200-600, triethylene glycol, glycerol, 1,2,6-hexanetriol, 1,2,4-butanetriol, petriol, 1,5-pentanediol, N-methyl-2-pyrrolidone, N-hydroxyethyl-2-pyrrolidone, 2-pyrrolidone, and 1,3-dimethylimidazolidinone. By using these solvents, excellent effects are produced in obtaining high solubility or dispersibility of the color material and in preventing ejection characteristic deficiency by moisture evaporation.

Further, it is preferable that ink contain a penetrating agent. The penetrating agent is added in order to improve the wetting properties of ink and a recording medium to adjust penetration speed. The penetrating agent is preferably expressed by one of the following formulas (I) through (IV). That is, a polyoxyethylene alkyl phenyl etheric surface active agent of (I), an acetylene glycolic surface active agent of (II), a polyoxyethylene alkyletheric surface active agent of (III), and a polyoxyethylene polyoxypropylene alkyl etheric surface active agent of (IV) can reduce the surface tension of liquid, and therefore, can improve wetting and increase penetration speed.

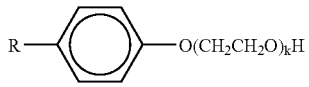

(I)

(R is a straight or branched hydrocarbon chain of 6-14 carbon atoms; k is 5-20);

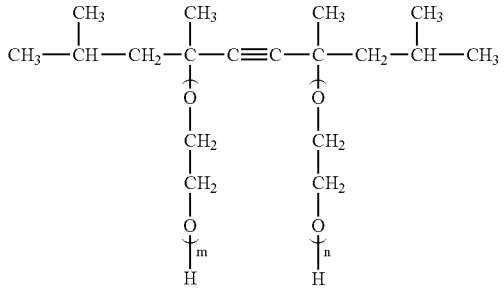

(m, n ≦ 20, 0< m+n < 40) ;

R—(OCH2CH2)nH (III)

(R is a straight or branched hydrocarbon chain of 6-14 carbon atoms; n is 5-20); and

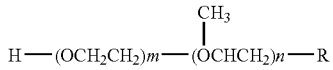

(IV)

(R is a hydrocarbon chain of 6-14 carbon atoms; m, n≦20).

Besides the compounds expressed by the above-described formulas (I) through (IV), for instance, polyalcoholic alkyl or aryl ethers such as diethyleneglycol monophenyl ether, ethyleneglycol monophenyl ether, ethyleneglycol monoaryl ether, diethyleneglycol monophenyl ether, diethyleneglycol monobutyl ether, propyleneglycol monobutyl ether, tetraethylene glycol chloro phenyl ether; nonionic surface active agents such as a polyoxyethylene polyoxypropylene block co-polymer; fluorochemical surface active agents; and lower alcohols such as ethanol and 2-propanol may be employed. In particular, diethyleneglycol monobutyl ether is preferable.

Further, it is preferable to add a pH regulator or a rust-preventive agent to ink in order to prevent elusion or corrosion of a member that comes into contact with the ink. Any substance may be used as a pH regulator as long as the substance can control pH to 6 or higher without adversely affecting ink with which the substance is blended. Examples of such pH regulators are: amines such as diethanol amine and triethanol amine; hydroxides of alkali metal elements such as lithium hydroxide, sodium hydroxide, and potassium hydroxide; ammonium hydroxide; quaternary ammonium hydroxides; quaternary phosphonium hydroxides; and alkali metal carbonates such as lithium carbonate, sodium carbonate, and potassium carbonate. Examples of rust-preventive agents are acid sulfites, sodium thiosulfite, ammonium thiodiglycolate, diisopropyl ammonium nitrite, pentaerythritol tetra nitrate, and dicyclohexyl ammonium nitrite.

Further, it is preferable to add a preservative/antimold agent to ink in order to prevent decay and mold. As preservative/antimold agents, for instance, sodium dehydroacetate, sodium sorbate, sodium 2-pyridinethiol-1-oxide, isothiazolin-based compounds, sodium benzoate, and sodium pentachloro phenol are employable.

Further, it is preferable to add an antifoaming agent to ink in order to control unnecessary foaming. As antifoaming agents, those based on silicon are preferably used. In general, silicon-based antifoaming agents are of an oil type, a compound type, a self-emulsification type, or an emulsion type. Considering aqueous use, it is preferable to use those of a self-emulsification or emulsion type in order to ensure reliability. Further, modified silicon-based antifoaming agents such as amino-modified, carbinol-modified, methacryl-modified, polyether-modified, alkyl-modified, higher fatty acid-modified, or alkylene oxide-modified antifoaming agents may also be used.

For instance, commercially available silicon-based antifoaming agents are silicone antifoaming agents (product names: KS508, KS531, KM72, KM85, etc.) of Shin-Etsu Chemical Co., Ltd.; silicone antifoaming agents (product names: Q2-3183A, SH5510, etc.) of Dow Corning Toray Silicone Co., Ltd.; silicone antifoaming agents (product name: SAG30 etc.) of Nippon Unicar Company Limited; and defoaming agents (product series name: ADEKANOL) of Asahi Denka Co., Ltd.

In accordance with one or more of the above-described features according to the present invention, recording liquid (ink) was adjusted and prepared so as to have a viscosity of 5 mPa•s or higher at 25° C. Then, the recording liquid was used in image forming apparatuses having the head cleaners according to the above-described embodiments, and the subsystem 81 was caused to perform the operation of maintaining and restoring the reliability of the recording heads 24 in each image forming apparatus so as to observe cleaning performance by the wiper blade 84. In each case, scattering or retransfer of recording liquid adhering to the wiper blade 84 was not or hardly observed, and desired image quality was obtained.

The present invention is applicable to image forming apparatuses such as printers, facsimile machines, copiers, and multi-function apparatuses having printer, facsimile, and copier functions. The present invention is also applicable to image forming apparatuses using recording liquid other than ink.

The present invention is not limited to the specifically disclosed embodiments, and variations and modifications may be made without departing from the scope of the present invention.

The present application is based on Japanese Priority Patent Application No. 2003-416707, filed on Dec. 15, 2003, the entire contents of which are hereby incorporated by reference.

What is claimed is:

1. A head cleaner, comprising:

a blade configured to wipe in a first direction a nozzle face of a liquid droplet ejecting head that ejects droplets of liquid from nozzles, the blade having a top face; and a cleaning part configured to clean the top face of the blade in a second direction perpendicular to the first direction by moving relative to the blade from a first longitudinal end to a second longitudinal end of the top face thereof.

2. The head cleaner as claimed in claim 1, wherein the cleaning part comprises:

a scraping member configured to scrape off liquid adhering to the top face.

3. The head cleaner as claimed in claim 2, wherein the cleaning part further comprises:

a transfer member configured to transfer the liquid adhering to the scraping member.

4. The head cleaner as claimed in claim 2, wherein the cleaning part cleans the blade when the blade is moved to a position where the blade is able to wipe the nozzle faces.

5. The head cleaner as claimed in claim 2, wherein the cleaning part further comprises:

a part configured to clean a side face of the blade.

6. The head cleaner as claimed in claim 1, wherein the cleaning part comprises:

a cloth member configured to wipe off liquid adhering to the top face of the blade.

7. The head cleaner as claimed in claim 1, wherein the cleaning part comprises:

a pump configured to apply suction on liquid adhering to the top face of the blade.

8. The head cleaner as claimed in claim 1, further comprising:

an additional cleaning part configured to clean a side face of the blade while the blade is being moved to a position where the blade is able to wipe the nozzle face of the liquid droplet ejecting head.

9. The head cleaner as claimed in claim 8, wherein the cleaning part is configured to move relative to the blade in a linear direction.

10. The head cleaner as claimed in claim 1, wherein the cleaning part is configured to move relative to the blade in a linear direction.

11. A head cleaner, comprising:

a blade configured to wipe a nozzle face of a liquid droplet ejecting head that ejects droplets of liquid from nozzles, the blade having a top face; and a cleaning part configured to clean the top face of the blade, wherein the cleaning part includes a cleaning member provided on a carriage carrying the liquid droplet ejecting head, the cleaning member includes first and second cleaning member parts, the first and second cleaning member parts are provided next to each other in a wiping direction in which the blade wipes the nozzle faces, the first cleaning member part being provided on an upstream side of the second cleaning member part in the wiping direction, and the first cleaning member part has a dimension greater than the second cleaning member part in the wiping direction.

12. The head cleaner as claimed in claim 11, wherein the cleaning member is an absorber capable of absorbing the liquid.

13. The head cleaner as claimed in claim 11, wherein the cleaning member projects more in a direction away from the carriage than the liquid droplet ejecting head.

14. The head cleaner as claimed in claim 11, wherein the cleaning member projects less in a direction away from the carriage than the liquid droplet ejecting head.

15. The head cleaner as claimed in claim 11, further comprising:

a part configured to clean a side face of the blade.

16. A head cleaner, comprising:

a blade configured to wipe a nozzle face of a liquid droplet ejecting head that ejects droplets of liquid from nozzles, the blade having a top face; and a cleaning part configured to clean the top face of the blade, wherein the cleaning part includes a cleaning member provided on a carriage carrying the liquid droplet ejecting head, the cleaning member includes first and second cleaning member parts, the first and second cleaning member parts are provided at upstream and downstream ends, respectively, on the carriage in the wiping direction, and the first cleaning member part has a dimension smaller than the second cleaning member part in the wiping direction.

17. The head cleaner as claimed in claim 16, wherein the cleaning member is an absorber capable of absorbing the liquid.

18. The head cleaner as claimed in claim 16, wherein the cleaning member projects more in a direction away from the carriage than the liquid droplet ejecting head.

19. The head cleaner as claimed in claim 16, wherein the cleaning member projects less in a direction away from the carriage than the liquid droplet ejecting head.

20. The head cleaner as claimed in claim 16, further comprising:

a part configured to clean a side face of the blade.

21. A head cleaner, comprising:

a blade configured to wipe a nozzle face of a liquid droplet ejecting head that ejects droplets of liquid from nozzles, the blade having a top face; and a cleaning part configured to clean the top face of the blade, wherein the liquid droplet ejecting head comprises a plurality of liquid droplet ejecting heads, and the blade is moved upward and downward every time each of the liquid droplet ejecting heads is cleaned.

22. A head cleaner, comprising:

a blade configured to wipe a nozzle face of a liquid droplet ejecting head that ejects droplets of liquid from nozzles; and a cleaning part configured to clean the blade when the blade is positioned so as to be able to wipe the nozzle face of the liquid droplet ejecting head, wherein the liquid droplet ejecting head comprises a plurality of liquid droplet ejecting heads, and the blade is moved upward and downward every time each of the liquid droplet ejecting heads is cleaned.

23. An image forming apparatus, comprising:

a liquid droplet ejecting head configured to eject droplets of liquid from nozzles; and a head cleaner including:

a blade configured to wipe in a first direction a nozzle face of the liquid droplet ejecting head, the blade having a top face; and a cleaning part configured to clean the top face of the blade in a second direction perpendicular to the first direction by moving relative to the blade from a first longitudinal end to a second longitudinal end of the top face thereof.

24. The image forming apparatus as claimed in claim 23, wherein:

the head cleaner further includes:

an additional cleaning part configured to clean a side face of the blade while the blade is being moved to a position where the blade is able to wipe the nozzle face of the liquid droplet ejecting head.

25. The head cleaner as claimed in claim 24, wherein the cleaning part is configured to move relative to the blade in a linear direction.

* * * * *